US008225626B1

(12) United States Patent
Blau

(10) Patent No.: US 8,225,626 B1
(45) Date of Patent: Jul. 24, 2012

(54) FLEXIBLE ADJUSTABLE SPLIT BAND WITH INDICIA ON THE EXTERIOR SURFACE OF THE BAND

(75) Inventor: Eddie Blau, Culver City, CA (US)

(73) Assignee: Innovation Specialties, Inc., Culver City, CA (US)

( * ) Notice: Subject to any disclaimer, the term of this patent is extended or adjusted under 35 U.S.C. 154(b) by 415 days.

(21) Appl. No.: 12/586,121

(22) Filed: Sep. 16, 2009

(51) Int. Cl.
*A44C 5/12* (2006.01)

(52) U.S. Cl. ..... 63/11; 63/3; 63/34; 40/586; D11/3; D11/4; D11/5

(58) Field of Classification Search ..... None
See application file for complete search history.

(56) References Cited

U.S. PATENT DOCUMENTS

| | | | | | |
|---|---|---|---|---|---|
| 222,176 | A | * | 12/1879 | Boyce | 428/589 |
| 249,861 | A | * | 11/1881 | Unger | 63/11 |
| 258,111 | A | * | 5/1882 | Pervear | 63/11 |
| 260,540 | A | * | 7/1882 | Cottle | 63/11 |
| 283,574 | A | * | 8/1883 | Cottle | 63/11 |
| 749,587 | A | * | 1/1904 | Simon | 63/11 |
| 1,797,583 | A | * | 3/1931 | Miller | 428/608 |
| D142,414 | S | * | 9/1945 | Hartley | D11/4 |
| 2,702,683 | A | * | 2/1955 | Cosser et al. | 248/309.4 |
| 2,954,620 | A | * | 10/1960 | Schneider | 40/633 |
| 3,800,450 | A | * | 4/1974 | Laugherty et al. | 40/633 |
| 3,889,411 | A | * | 6/1975 | Laugherty et al. | 40/633 |
| 4,087,989 | A | * | 5/1978 | Taran | 63/11 |
| D254,198 | S | * | 2/1980 | Hardy | D11/4 |
| 4,357,694 | A | * | 11/1982 | Montuori | 368/282 |
| 5,343,608 | A | * | 9/1994 | MacDonald | 29/450 |
| 5,740,623 | A | * | 4/1998 | Juhan et al. | 40/633 |
| D414,129 | S | * | 9/1999 | Clegg | D11/4 |
| D492,908 | S | * | 7/2004 | Njai et al. | D11/4 |
| D497,565 | S | * | 10/2004 | Pink | D11/4 |
| D545,715 | S | * | 7/2007 | Thiessen | D11/3 |
| D547,228 | S | * | 7/2007 | Rozsavolgyi | D11/5 |
| D565,448 | S | * | 4/2008 | Prak et al. | D11/4 |
| D575,657 | S | * | 8/2008 | Lee | D11/4 |
| D575,658 | S | * | 8/2008 | Lee | D11/4 |
| D578,429 | S | * | 10/2008 | Momjian | D11/79 |
| D597,436 | S | * | 8/2009 | Bowdish | D11/4 |
| D605,544 | S | * | 12/2009 | Morelli | D11/4 |
| D623,978 | S | * | 9/2010 | Cerullo | D11/3 |
| 7,905,111 | B2 | * | 3/2011 | Saltz | 63/3 |
| 2002/0043077 | A1 | * | 4/2002 | Boyadjian | 63/3 |

* cited by examiner

*Primary Examiner* — Jack W. Lavinder
(74) *Attorney, Agent, or Firm* — Thomas I. Rozsa

(57) ABSTRACT

A flexible adjustable split band with indicia on the exterior surface. The interior is made of injection molded spring plastic and an exterior covering is made of material selected from the group consisting of lanyard material, polyester fabric, and other stretchable material which can be heat sealed and onto which indicia can be placed by methods such as silkscreening or weaving. The band is formed by starting with an injection molded core of spring plastic of a given width and length which is formed into a curve and is separated at its two respective ends so that gap is created between the ends of the plastic core. A covering material such as lanyard material or polyester is slipped over the plastic core and is heat sealed at one end. The covering then pulled tightly over the plastic core and cut to size and heat sealed at its opposite end. An end cap made of ABS plastic or comparable material is then affixed onto each end of the band.

10 Claims, 3 Drawing Sheets

FLEXIBLE ADJUSTABLE SPLIT BAND WITH INDICIA ON THE EXTERIOR SURFACE OF THE BAND

BACKGROUND OF THE INVENTION

1. Field of the Invention

The present invention relates to the field of bracelets and/or bands which are worn on a body part, especially a wrist, and which contain written material thereon which can include an advertising message, a company logo, or other promotional material.

2. Description of the Prior Art

Wrist bands and bracelets are common items which are generally known in the prior art. However, there is a significant need for a new and improved flexible and adjustable split band which can have any desired indicia affixed thereon.

SUMMARY OF THE INVENTION

The present invention is a flexible adjustable split band with indicia on the exterior surface. The interior is comprised of injection molded spring plastic and an exterior covering is made of material selected from the group consisting of lanyard material, polyester fabric, and other stretchable material which can be heat sealed and onto which indicia can be placed by methods such as silkscreening or weaving.

The present invention is formed by starting with an injection molded core of spring plastic of a given width and length which is formed into a curve and is separated at its two respective ends so that gap is created between the ends of the plastic core. A covering material such as lanyard material or polyester is slipped over the plastic core and is heat sealed at one end. The covering then pulled tightly over the plastic core and cut to size and heat sealed at its opposite end. An end cap made of ABS plastic or comparable material is then affixed onto each end of the band. In order to assure a tight fit of the covering over the plastic core, a high powered heat gun is blown over the fabric to cause it to shrink and to conform to the shape of the plastic core, thereby removing wrinkles and other imperfections in the surface of the covering. Indicia are then placed onto the outer surface and/or the inner surface of the outer covering by means selected from the group consisting of silkscreening the indicia onto the outer covering of the material and weaving the indicia into the material on the outer covering.

It is an object of the present invention to create a flexible and adjustable band which can be conformed to the shape of any person's wrist by creating the band with an inner core of spring plastic that is separated by a gap at its two respective ends so that the core can be expanded by a pulling force of two opposite sections of the band so that the band can be fit over a person's wrist and then compressed so that the band is adjusted to fit the size of the person's wrist, the flexibility of the core and the gap facilitating this adjustment.

It is a further object of the present invention to create a flexible and tight fitting covering over the inner core of the band, the covering being heat sealed at the two respective ends of the inner core and thereafter heated so that the covering fits flexibly and smoothly against the surface of the inner core so that wrinkles and other imperfections are removed. The ends of the band are covered by end caps made of injection molded ABS plastic which have an interior chamber which surrounds a respective end of the band, the end cap affixed to the end of the band by adhesive means such as glue or heat activated adhesive.

It is an additional object of the present invention to create a band with an outer wrapping which is made of material that: (1) can be heat sealed at the ends of the band, (2) can be heat shrunk so that the outer wrapping fits smoothly against the surface of the inner core with wrinkles and other imperfections removed, and (3) is made of material which can have indicia such as word, letter, numbers, etc. visibly embedded into the outer wrapper by means such as silkscreening or printing the indicia onto the outer wrapper of the band or weaving and/or stitching the indicia into the outer wrapper of the band. The wrapper covers the entire surface of the inner core so that indicia can be affixed onto and or into the outer surface of the wrapper of the band which is visible when the band is worn and can also be placed on the inner surface of band which is adjacent the wearer's skin. The preferred material for the outer wrapper is lanyard material or polyester fabric.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Figure 1:
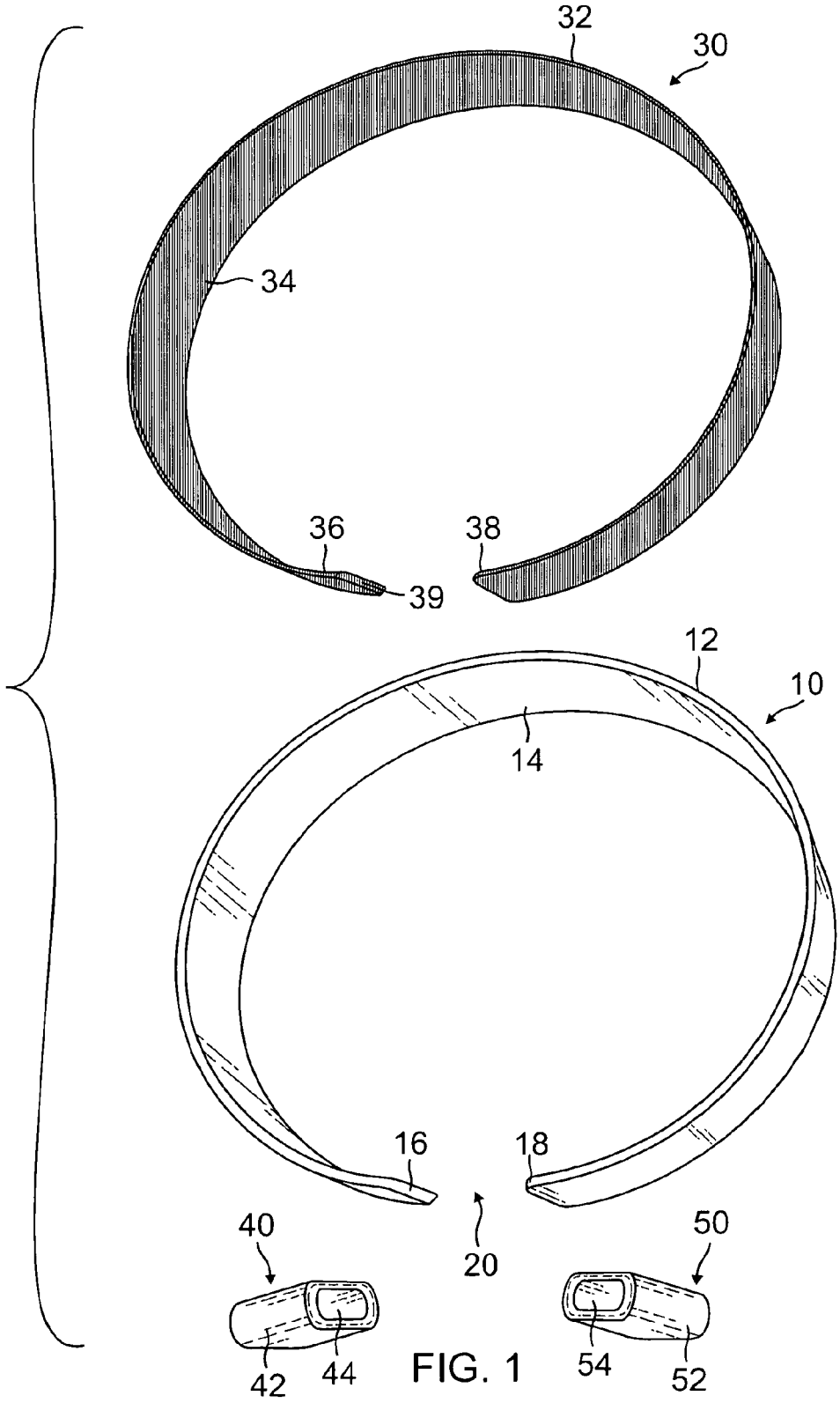
FIG. 1 is an exploded view showing the components of the present invention flexible adjustable split band, which include the outer wrapper material which will be stretched over the inner core and heat sealed adjacent each respective end of the inner core, the inner core made of spring plastic, and the injection molded end caps made of ABS plastic which will be affixed to each respective end of the band after the outer wrapping has been tightly sealed onto the inner core.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring to FIGS. 1 through 5, the inner core 10 is formed out of a single piece of material and preferably is made of spring plastic although other materials such as spring metal are also within the spirit and scope of the present invention. The inner core 10 is generally rectangular in shape and is formed into an arc as shown. The inner core has an outer surface 12, and inner surface 14, a first end 16 and a second end 18. When formed into the arc, the ends 16 and 18 are separated by a gap 20.

The inner core is covered by an outer wrapper 30 which has an exterior outer surface 32, an interior outer surface 34, a first end 36, a second end 38 and an interior chamber 39 which is surrounded by the exterior outer surface 32 and the interior outer surface 34 and extends from the first end 36 to the second end 38. The outer wrapper 30 is slid over the inner core 10 by inserting first end 16 of inner core 10 into interior chamber 39 at the location of second end 38 of the outer wrapper 30 and pulling the outer wrapper 30 over the inner core 10 until first end 36 of outer wrapper 30 is adjacent first end 16 of inner core 10. The first end 36 of the outer wrapper 30 is then heat sealed against first end 16 of inner core 10. The outer wrapping 30 is then cut so that second end 38 is adjacent second end 18 of inner core 10 and then the second end 38 of outer wrapper 30 is heat sealed against the second end 18 of inner core 10. The exterior outer surface 32 and interior outer surface 34 of outer wrapper 30 are then heated with a heat gun so that the outer wrapper is tightly affixed against the outer surface 12 and inner surface 14 of inner core 10 so that wrinkles and other imperfections of the outer wrapper 30 are thereby removed.

The first end cap 40 has an exterior surface 42 which surrounds an inner chamber 44. The first end 36 of outer wrapping 30 has adhesive means 46 such as glue placed over the exterior outer surface 32 and interior outer surface 34 at a location adjacent first end 36 and then first end 36 is inserted into inner chamber 44 of first end cap 40 and the first end cap 40 is thereby affixed over the first end 36 of the outer wrapper 30.

The second end cap 50 has an exterior surface 52 which surrounds an inner chamber 54. The second end 38 of outer wrapping 30 has adhesive means (not shown) such as glue placed over the exterior outer surface 32 and interior outer surface 34 at a location adjacent second end 38 and then second end 38 is inserted into inner chamber 54 of second end cap 50 and the second end cap 50 is thereby affixed over the second end 38 of the outer wrapper 30.

The first and second end caps 40 and 50 are separated by gap 20. First and second end caps 40 and 50 are preferably made out of injection molded ABS plastic, but other materials such as metal, polyvinyl, and polyvinyl chloride are also within the spirit and scope of the present invention.

Indicia 60 selected from the group consisting of letters, words, names, company names, numbers, symbols, graphics, logos, and marks are then affixed into or onto the outer wrapper 30. The indicia 60 are usually affixed onto or into the exterior outer surface 32 of outer wrapper 30. The indicia can also be affixed onto or into the interior outer surface 34 of outer wrapper 30. Depending on the material the outer wrapper 30 is made of, the indicia are silkscreened or printed onto the outer wrapper 30 or woven or stitched into the outer wrapper 30. The outer wrapper 30 is made of polyester fabric or lanyard material so that the indicia can be silkscreened or printed onto the outer wrapper 30 or woven or stitched into the outer wrapper 30.

Figure 2:
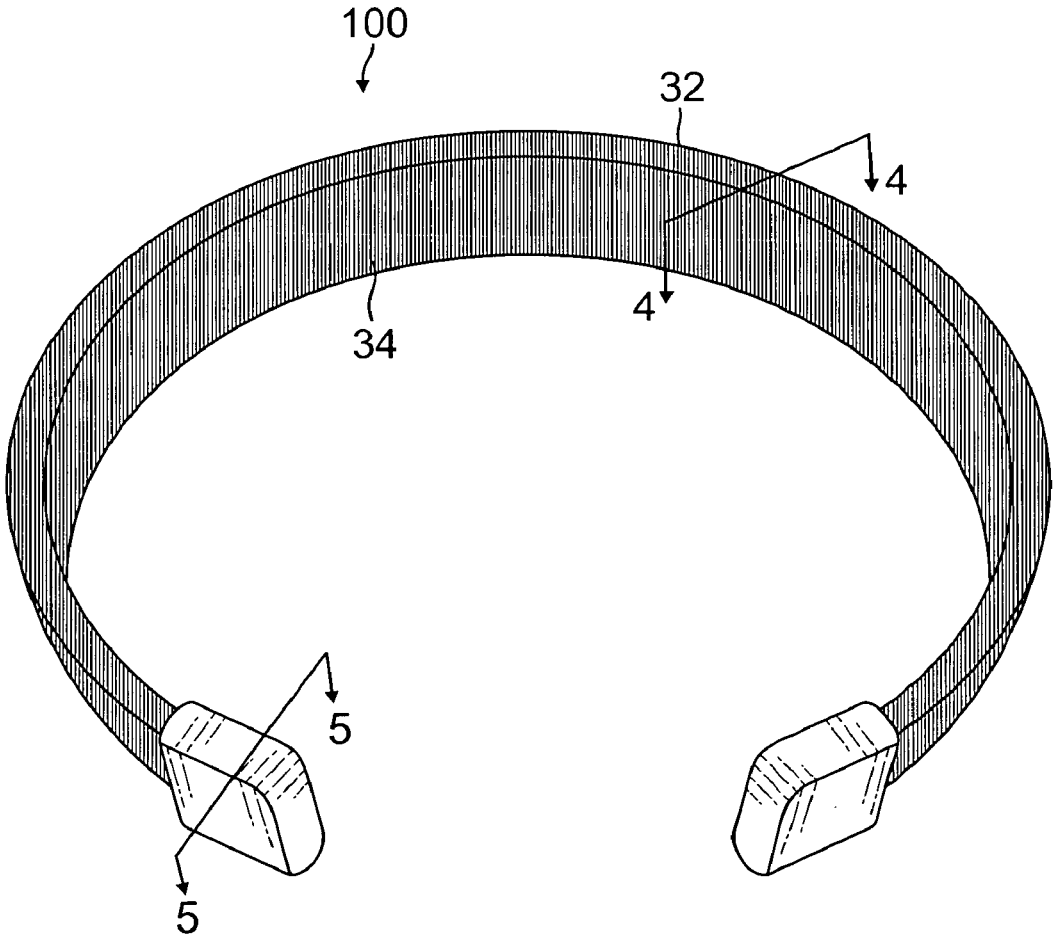
FIG. 2 is a perspective view when viewed from the inside of the band of the completed and assembled band of the present invention.
Figure 3:
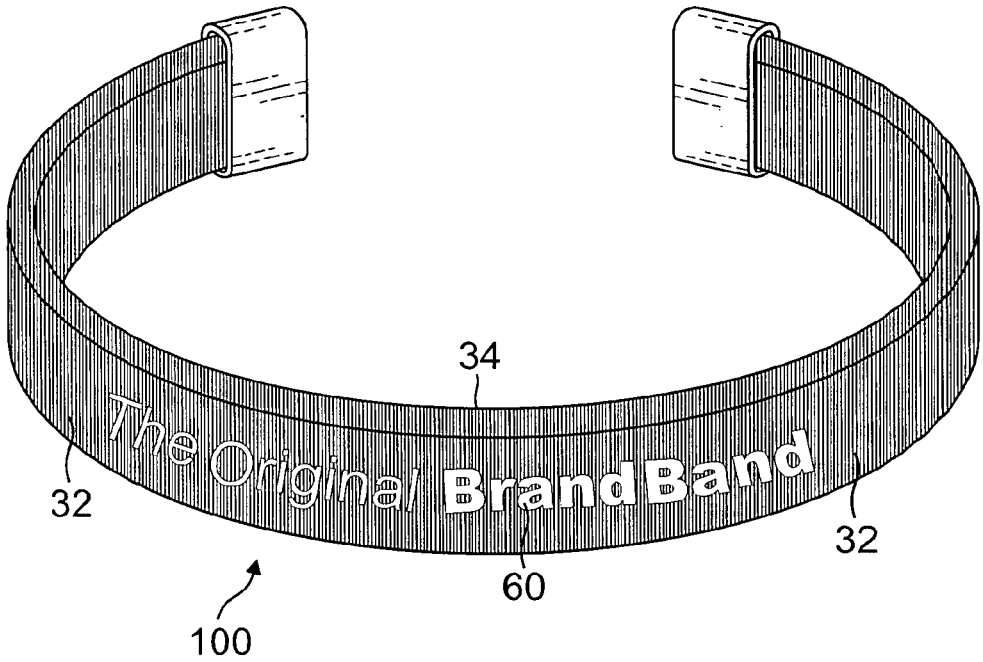
FIG. 3 is a perspective view when viewed from the outside of the band of the completed and assembled band of the present invention.
Figure 4:
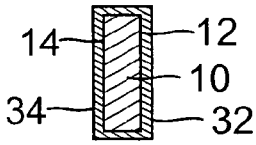
FIG. 4 is a cross-sectional view taken along line 4-4 of FIG. 2, showing the inner core and the outer wrapping.
Figure 5:
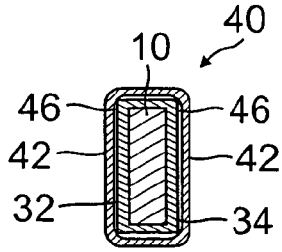
FIG. 5 is a cross-sectional view taken along line 5-5 of FIG. 2, showing the affixation of an end cap over the outer wrapper at an end of the band.

The fully formed band 100 as illustrated in FIGS. 2 and 3 can be stretched by a pulling on opposite sides of the band so that the band 100 can be fit over a wrist of any size and then a compression force on the exterior wrapper 30 compresses the band 100 to fit the wrist size of the wearer. The band 100 can be used as a decorative jewelry accessory, as a promotional item for a business or individual, or can be made out of one or more colors to symbolize an event, occurrence, or any other activity represented by the color or colors. The indicia 60 and 62 can be customized for any purpose such as advertising, promotion, decoration, etc.

Defined in detail, the present invention is a band comprising: (a) an inner core which is generally rectangular in shape and made out of spring material formed into an arc, the inner core having an outer surface, an inner surface, a first end and a second end, the first and second ends separated by a gap when the inner core is formed into an arc; (b) an outer wrapper having an exterior outer surface, an interior outer surface, a first end, a second end, and an interior chamber which is surrounded by the exterior outer surface and the interior outer surface; (c) the inner core placed into the interior chamber of the outer wrapper, the outer wrapper sealed onto the inner core so that the first end of the outer wrapper is adjacent the first end of the inner core, the second end of the outer wrapper is adjacent the second end of the inner core, the exterior outer surface of the outer wrapper rests over the outer surface of the inner core, the interior outer surface of the outer wrapper rests over the inner surface of the inner core, the outer wrapper having no wrinkles and being flexible so that the outer wrapper conforms to the shape of the arc; (d) a first end cap having an exterior surface and an inner chamber, the first end of the outer wrapper and a portion of the exterior outer surface and interior outer surface of the outer wrapper adjacent the first end permanently affixed into the inner chamber of the first end cap; (e) a second end cap having an exterior surface and an inner chamber, the second end of the outer wrapper and a portion of the exterior outer surface and interior outer surface of the outer wrapper adjacent the second end permanently affixed into the inner chamber of the second end cap; and (f) indicia on the outer wrapper.

Defined alternatively in detail, the present invention is forming a band by the method comprising: (a) starting with an injection inner molded core of spring plastic of a given width and length which is formed into an arc and is separated at its two respective ends so that gap is created between the ends of the plastic core; (b) slipping an outer wrapper material over the inner core, heat sealing a first end of the outer wrapper material at one end of the inner core, cutting the outer wrapper material so a second end of the outer wrapper material is adjacent a second end of the inner core and heat sealing the outer wrapper material at its second end; (c) heating the outer wrapper material so that wrinkles and imperfections are removed from the outer wrapper material, and the outer wrapper material forms an exterior outer surface and an interior outer surface over the inner core; (d) permanently affixing a first end cap over the first end of the outer wrapper and permanently affixing a second end cap over the second end of the outer wrapper; and (e) affixing indicia on to outer wrapper.

Of course the present invention is not intended to be restricted to any particular form or arrangement, or any s specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A band comprising:

a. an inner core which is generally rectangular in shape and made out of spring material formed into an arc, the inner core having an outer surface, an inner surface, a first end and a second end, the first and second ends separated by a gap when the inner core is formed into an arc;

b. an outer wrapper having an exterior outer surface, an interior outer surface, a first end, a second end, and an interior chamber which is surrounded by the exterior outer surface and the interior outer surface;

c. the inner core placed into the interior chamber of the outer wrapper, the outer wrapper sealed onto the inner core so that the first end of the outer wrapper is adjacent the first end of the inner core, the second end of the outer wrapper is adjacent the second end of the inner core, the exterior outer surface of the outer wrapper rests over the outer surface of the inner core, the interior outer surface of the outer wrapper rests over the inner surface of the inner core, the outer wrapper having no wrinkles and being flexible so that the outer wrapper conforms to the shape of the arc;

d. a first end cap having an exterior surface and an inner chamber, the first end of the outer wrapper and a portion of the exterior outer surface and interior outer surface of the outer wrapper adjacent the first end permanently affixed into the inner chamber of the first end cap;

e. a second end cap having an exterior surface and an inner chamber, the second end of the outer wrapper and a portion of the exterior outer surface and interior outer surface of the outer wrapper adjacent the second end permanently affixed into the inner chamber of the second end cap; and f. indicia on the outer wrapper.

2. The band in accordance with claim 1 wherein the inner core is made out of material selected from the group consisting of spring plastic and spring metal.

3. The band in accordance with claim 1 wherein the first end cap is made out of injection molded ABS plastic and the second end cap is made out of injection molded ABS plastic.

4. The band in accordance with claim 1 wherein the outer wrapper is made out of material selected from the group consisting of lanyard material and polyester fabric.

5. The band in accordance with claim 1 wherein the first end cap is permanently affixed by adhesive and the second end cap is permanently affixed by adhesive.

6. The band in accordance with claim 1 wherein the indicia is selected from the group consisting of letters, words, names, company names, numbers, symbols, graphics, logos and marks.

7. The band in accordance with claim 1 wherein the indicia is affixed onto the exterior outer surface of the outer wrapper by silkscreening.

8. The band in accordance with claim 1 wherein the indicia is affixed into the exterior outer surface of the outer wrapper by weaving.

9. The band in accordance with claim 1 wherein the indicia is affixed onto the interior outer surface of the outer wrapper by silkscreening.

10. The band in accordance with claim 1 wherein the indicia is affixed into the interior outer surface of the outer wrapper by weaving.

* * * * *